US009359767B2

(12) United States Patent
Glick, Jr.

(10) Patent No.: US 9,359,767 B2
(45) Date of Patent: Jun. 7, 2016

(54) Z-SHAPED CLOSURE MEMBER WITH FILTER RETENTION FEATURES

(71) Applicant: Emanuel S. Glick, Jr., Morgantown, PA (US)

(72) Inventor: Emanuel S. Glick, Jr., Morgantown, PA (US)

( * ) Notice: Subject to any disclaimer, the term of this patent is extended or adjusted under 35 U.S.C. 154(b) by 0 days.

(21) Appl. No.: 14/819,246

(22) Filed: Aug. 5, 2015

(65) Prior Publication Data

US 2016/0069082 A1 Mar. 10, 2016

Related U.S. Application Data

(60) Provisional application No. 62/046,949, filed on Sep. 6, 2014.

(51) Int. Cl.

| | |
|---|---|
| ***E04D 13/17*** | (2006.01) |
| ***E04D 11/00*** | (2006.01) |
| ***F24F 7/02*** | (2006.01) |

(52) U.S. Cl.

CPC ..... *E04D 13/174* (2013.01); *E04D 11/005* (2013.01); *F24F 7/02* (2013.01); *F24F 2221/52* (2013.01)

(58) Field of Classification Search

CPC ..... E04D 13/174; E04D 11/005; F24F 7/02; F24F 2221/52

See application file for complete search history.

(56) References Cited

U.S. PATENT DOCUMENTS

| | | | | | |
|---|---|---|---|---|---|
| 3,185,070 | A * | 5/1965 | Smith | E04D 13/174 | 454/365 |
| 4,114,340 | A * | 9/1978 | Dean | E04D 3/363 | 52/520 |
| 4,532,739 | A * | 8/1985 | Cooper | E04D 1/30 | 52/465 |
| 4,554,862 | A * | 11/1985 | Wolfert | E04D 13/002 | 454/365 |
| 4,685,265 | A * | 8/1987 | Cooper | E04D 1/30 | 454/365 |
| 4,995,308 | A * | 2/1991 | Waggoner | E04D 13/152 | 454/254 |
| 5,167,579 | A * | 12/1992 | Rotter | E04D 1/36 | 454/365 |
| 5,174,076 | A * | 12/1992 | Schiedegger | F24F 7/02 | 454/3 |
| 5,427,571 | A | 6/1995 | Selis | | |
| 5,605,022 | A | 2/1997 | Fulton | | |
| 5,706,618 | A * | 1/1998 | Pratt | E04D 13/174 | 454/364 |
| 5,803,806 | A * | 9/1998 | Blessinger | F24F 7/02 | 454/365 |
| 6,128,870 | A * | 10/2000 | Kohler | E04D 1/3402 | 454/365 |

(Continued)

FOREIGN PATENT DOCUMENTS

| | | | | |
|---|---|---|---|---|
| DE | 9107785 U1 * | 9/1991 | ..... | E04D 13/174 |

OTHER PUBLICATIONS

Machine translation for DE 9107785 U1 prepared by EPO on Jan. 4, 2016 (4 pages).*

*Primary Examiner* — Rodney Mintz

(74) *Attorney, Agent, or Firm* — Miller Law Group, PLLC

(57) ABSTRACT

A Z-closure member for raised seam roofs is formed through bending techniques into a shape having a ventilated central vertical member, an upper mounting flange terminating in an upper tab member, and a lower flange member extending in an opposing direction from the upper mounting flange member and terminating in a flexible locking tab. The lower flange is secured to a raised seam roofing panel with fasteners, while the vent cap formed with a return lip is engaged with the upper flange by capturing the upper flange within the return lip. A fastener can be inserted through the vent cap return lip and the upper flange to secure the vent cap to the Z-closure member. A mesh filter is trapped against the vertical member by the upper tab member and the lower flexible locking tab. A seal can be added to the lower flange to seal against the roofing panel.

18 Claims, 9 Drawing Sheets

(56) References Cited

U.S. PATENT DOCUMENTS 6,598,356 B1 * 7/2003 Sells ..... E04D 13/174 52/198
6,662,510 B2 12/2003 Rotter
6,997,800 B1 * 2/2006 Kohler ..... E04D 13/174 454/365
7,788,857 B2 9/2010 Spengler
7,823,343 B1 * 11/2010 Inzeo ..... E04D 13/1478 454/365
8,075,376 B1 * 12/2011 Inzeo ..... E04D 13/1478 454/367
2001/0052207 A1 12/2001 Davis
2002/0095882 A1 * 7/2002 Rotter ..... F24F 7/02 52/199
2002/0194799 A1 * 12/2002 Sharp ..... E04D 13/174 52/198
2008/0318516 A1 * 12/2008 Rotter ..... E04D 13/174 454/365
2011/0016803 A1 * 1/2011 Ray ..... E04D 3/3608 52/90.2
2012/0192519 A1 * 8/2012 Ray ..... E04D 3/366 52/520
2013/0074428 A1 * 3/2013 Allen ..... E04D 13/17 52/173.3
2013/0167833 A1 * 7/2013 Daniels ..... F24J 2/30 126/621
2013/0344796 A1 12/2013 Rossetta
2014/0179220 A1 * 6/2014 Railkar ..... E04D 3/30 454/365

* cited by examiner

Z-SHAPED CLOSURE MEMBER WITH FILTER RETENTION FEATURES

CROSS-REFERENCE TO RELATED APPLICATIONS

This application claims domestic priority on U.S. Provisional Patent Application Ser. No. 62/046,949, filed on Sep. 6, 2014, the content of which is incorporated herein by reference.

FIELD OF THE INVENTION

This invention relates generally to the mounting of a vent cap on a raised seam roof, and more particularly, to a Z-closure member providing ventilation to a vent cap mounted on a raised seam roof in which the Z-closure member is formed with a filter retention features.

BACKGROUND OF THE INVENTION

Raised seam roofs are formed with U-shaped roof panels wherein the upright legs of the roof panels are joined to the upright legs of the adjacent roof panels to create a seam between adjacent roof panels. Precipitation is drained downwardly toward the roof line along the horizontal portion of the roof panel to keep the moisture away from the raised seam. At the peak of the roof structure, a vent cap is typically applied to cover the spaced between the opposing roof panels. The vent cap is typically secured to the roof panels by fasteners that connect the vent cap to a support member, which in turn is connected by fasteners to the individual roof panels. This support member can be in the shape of a Z having horizontal flanges that connect via fasteners to the vent cap and the roof panel, respectively, with a vertical flange interconnecting the horizontal flanges. The vertical flange can be formed with a plurality of openings to permit the passage of air from the outside the roof structure into the vent cap, or vice versa.

A Z-shaped support member is disclosed in U.S. Pat. No. 5,427,571, granted to Gary L. Selis on Jun. 17, 1995, in which the Z-shaped support member is connected to the roofing member by fasteners 68 extending through the lower horizontal flange, and to the vent cap member by fasteners 46 extending through the upper horizontal flange. The ventilation to the vent cap in the Selis patent is provided through corrugated material incorporated into the vent cap where the fastener 46 passes through the corrugated material to reach the upper horizontal flange of the Z-shaped support member.

A formed Z-closure member is disclosed in U.S. Pat. No. 5,605,022, issued on Feb. 25, 1997, to David A. Fulton to connect a vent cap to a specialized raised seam roof structure. The Fulton Z-closure member has a formed shape that includes an upper horizontal flange that is connected to the vent cap through fasteners 62. The Z-closure member has a lower horizontal flange that is connected to the roof panels through fasteners 60. The lower horizontal flange also includes a formed inner sidewall portion that extends upwardly and terminates in a lip that establishes a cavity that directs air flow in a particular manner through the vertical portion of the Z-closure member, which is formed with ventilation openings, then upwardly over the inner sidewall. The ventilation openings are covered by a screen that is trapped between integrally formed screen clamps on the back side of the ventilated vertical member.

In U.S. Pat. No. 6,662,510, issued on Dec. 16, 2003, to Martin J. Rotter, a roof ventilation strip is mounted to a raised panel roof structure where the vent cap would overlie the ventilation strip. The vent cap is connected to the raised seam portions by fasteners passing through the ventilation strip. The roof structure disclosed in U.S. Pat. No. 7,788,857, granted on Sep. 7, 2010, to Jeffrey Sprengler, et al, includes a Z-shaped support member positioned between the upright legs of the roof panel members. The Sprengler Z-shaped support member includes an upper horizontal flange that connects to a vent cap, but the lower horizontal flange further includes a formed wrap around portion that includes a hinge 14 that permits the wrap around portion to be positioned below the roof panel member. A fastener can then pass through the lower horizontal flange, through the roof panel member and then through the wrap around portion. The Sprengler Z-shaped support member does not teach the use of ventilation openings through the vertical member for the passage of air into the vent cap, although the lower horizontal flange is formed with openings for the passage of the fasteners to connect the Z-shaped support member to the roof panels.

U.S. Patent Application Publication No. 2001/0052207 of Robert Davis, published on Dec. 20, 2001, discloses a Z-closure member having an upper horizontal flange for connection to a vent cap and a lower horizontal flange for connection to a Z-shaped support member positioned between the upright legs of a raised seam roof structure. A vertical member interconnects the upper and lower horizontal flanges and is provided with ventilation openings for the passage of air from outside the roof structure to inside the vent cap.

Similarly, U.S. Patent Application Publication No. 2013/0344796 of Daniel Rossetta, published on Dec. 26, 2013, discloses a Z-closure member connecting a vent cap to a shingled roof structure. The Z-closure member is shown to have several configurations, but essentially consists of the upper and lower horizontal flanges for connection to the Z-closure member to the vent cap and to the roof structure, respectively. The vertical portion of the Z-closure member is formed with ventilation openings that allow for the passage of air through the Z-closure member into or from the vent cap.

It would be desirable to provide a formed Z-closure member for use with raised seam roof structures where the Z-closure member can be formed through conventional metal bending machines and provide structure for retaining a filter member without requiring specially formed clamps or other structure for retaining the filter against the vertical face of the Z-closure member.

SUMMARY OF THE INVENTION

It is an object of this invention to overcome the disadvantages of the prior art by providing a formed Z-closure member that provides structure for retaining a filter member without requiring specially formed clamps or other structure for retaining the filter against the face of the Z-closure member.

It is another object of this invention to provide a Z-closure member that can be formed by bending a single sheet of metal into the desired shape.

It is a feature of this invention that the formed shape of the Z-closure member accommodates the attachment of the Z-closure member to the roofing panels while accommodating the connection of a vent cap.

It is another feature of this invention that the Z-closure member has a lower flange that fits between the raised seams of the roofing panels of a raised seam roof.

It is an advantage of this invention that the lower flange of the Z-closure member can be attached to the body portion of a raised seam roof panel by fasteners extending through the lower flange and into the roof panel.

It is still another feature of this invention that the Z-closure member has an upper flange oriented in an opposing direction from the lower flange to affect mounting of the vent cap thereto.

It is another advantage of this invention that a vent cap formed with a connecting flange can be engaged with the upper flange of the Z-closure member without fasteners.

It is still another advantage of this invention that the attachment of the vent cap to the upper flange of the Z-closure member can be reinforced with the addition of fasteners extending through the connecting flange of the vent cap and the captured upper flange of the Z-closure member.

It is another feature of this invention that the lower flange is formed with a lower flexible locking tab that assists in retaining the filter in place against the central vertical member.

It is yet another feature of this invention that the lower flange can have an elastomeric seal secured to the bottom surface thereof to form a seal between the lower flange and the body portion of the roofing panel to which the Z-closure member is attached.

It is yet another advantage of this invention that the elastomeric seal will seal the insertions of fasteners through the lower flange into the body portion of the roofing panel.

It is a further feature of this invention that the central vertical member of the Z-closure member is formed with ventilation openings to allow the passage of air between the vent cap and the roof panel.

It is yet a further feature of this invention that the central vertical member can also be formed with weep holes to allow any moisture passing through the ventilation openings into engagement with the filter to drain from the Z-closure member.

It is still another object of this invention to provide a Z-closure member that provides ventilation between a vent cap and a raised seam roofing panel that is convenient to install.

It is yet another object of this invention to provide a Z-closure member for providing ventilation between a vent cap and a roofing panel, which is durable in construction, inexpensive of manufacture, carefree of maintenance, facile in assemblage, and simple and effective in use.

These and other objects, features, and advantages are accomplished according to the instant invention by providing a Z-closure member formed through bending a single sheet of sheet metal into a shape having a ventilated central vertical member, an upper mounting flange terminating in an upper tab member, and a lower flange member extending in an opposing direction from the upper mounting flange member and terminating in a flexible locking tab. The lower flange is secured to a raised seam roofing panel with fasteners, while the vent cap formed with a return lip is engaged with the upper flange by capturing the upper flange within the return lip. A fastener can be inserted through the vent cap return lip and the upper flange to secure the vent cap to the Z-closure member. A mesh filter is trapped against the vertical member by the upper tab member and the lower flexible locking tab. A seal can be added to the lower flange to seal against the roofing panel.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENTS

Figure 1:
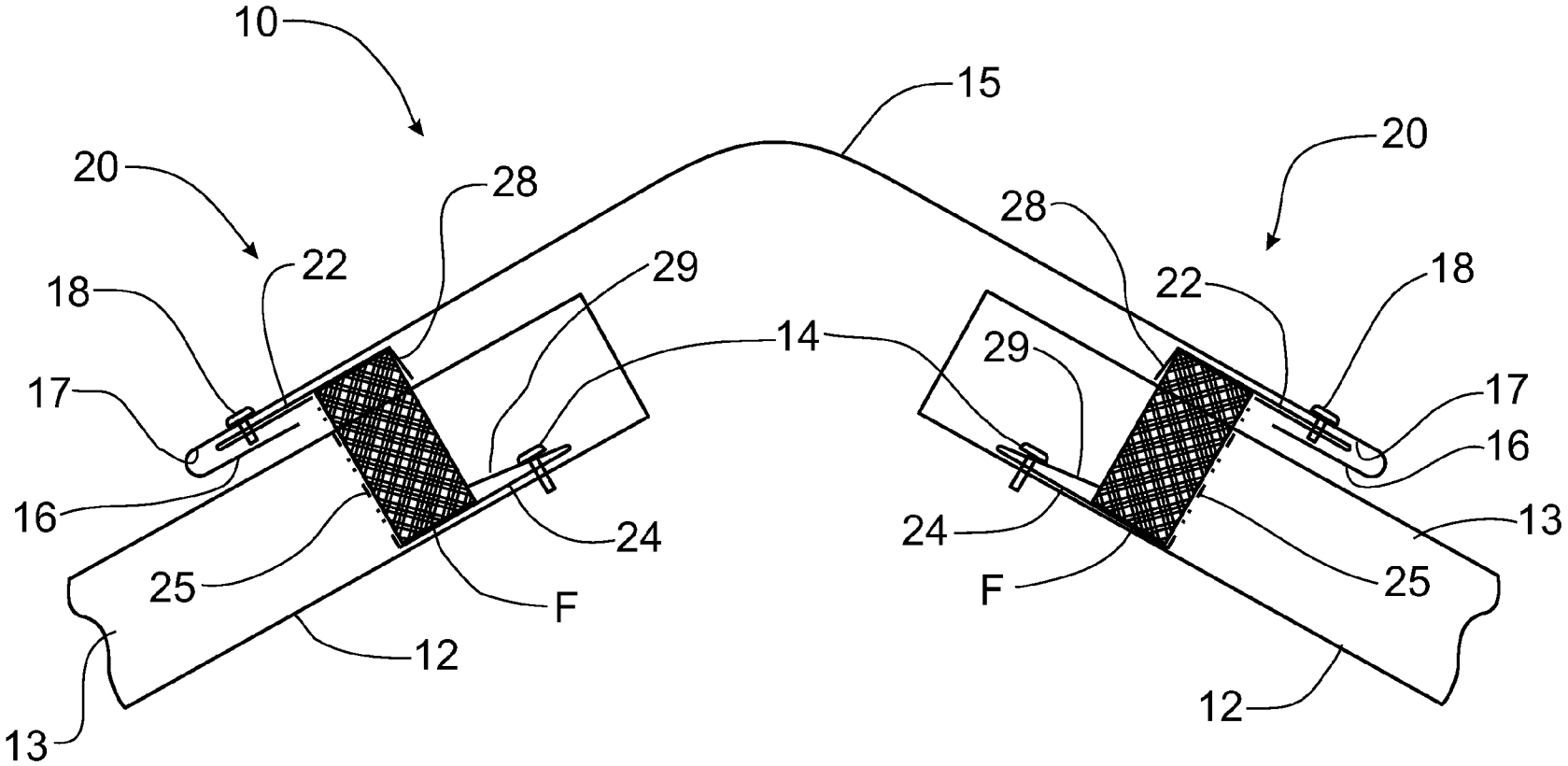
FIG. 1 is a schematic cross-sectional view of a vent cap mounted on a raised seam roof structure by Z-closure members incorporating the principles of the instant invention.
Figure 2:
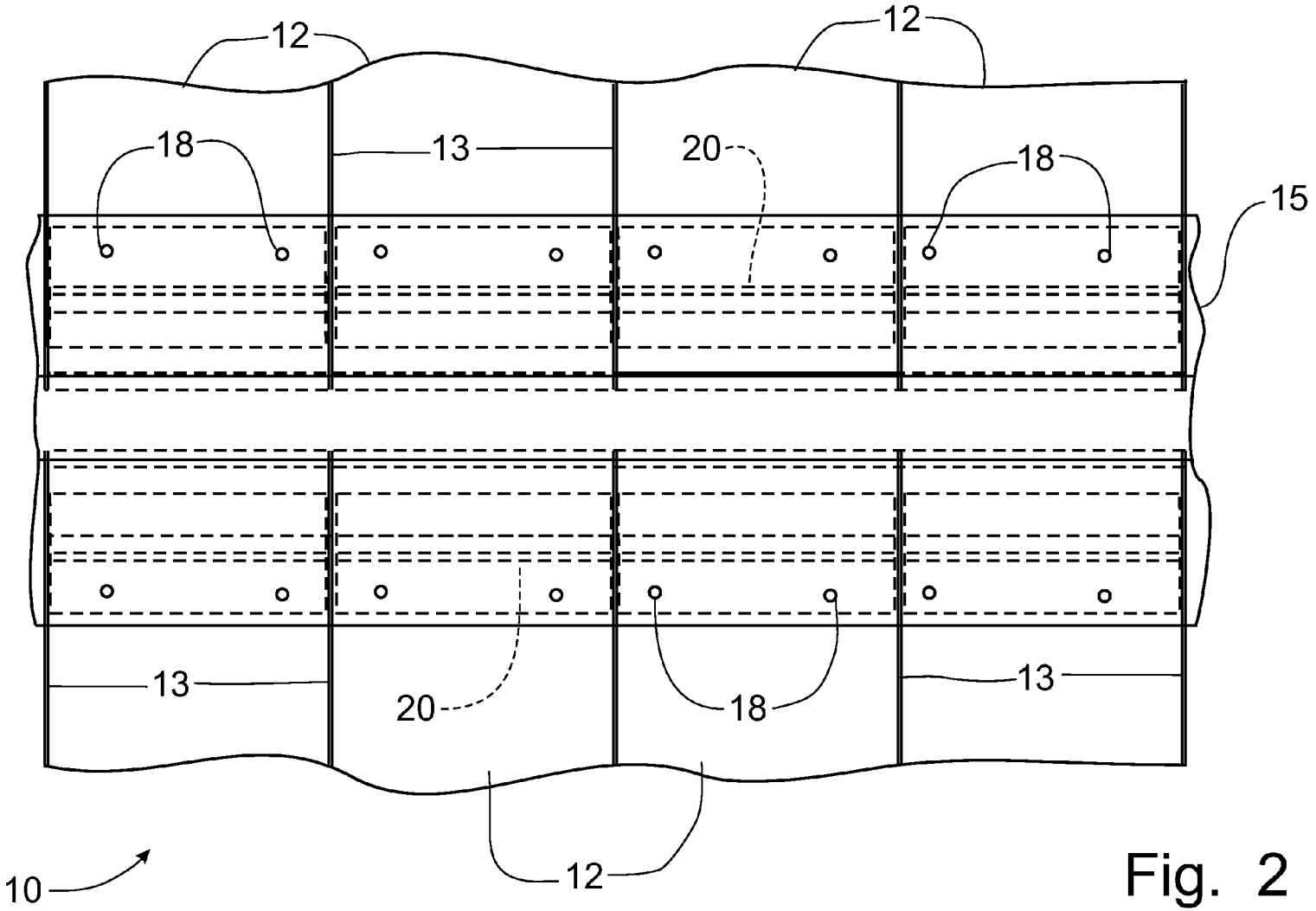
FIG. 2 is a partial schematic top plan view of a vent cap mounted on a raised seam roof structure as depicted in FIG. 1.
Figures 3, 4:
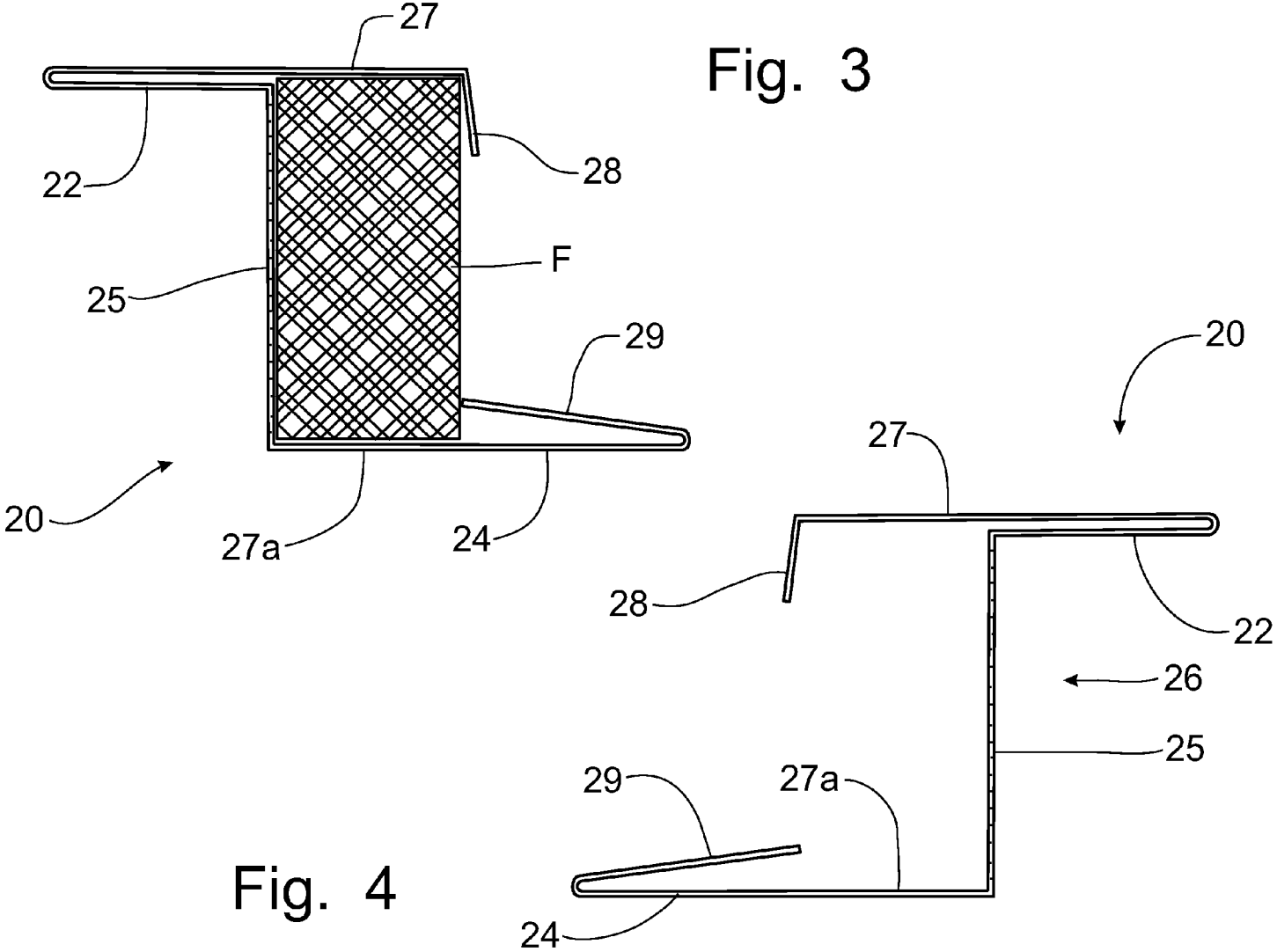
FIG. 3 is a schematic left elevational view of the Z-closure member incorporating the principles of the instant invention, a representative filter secured by the retention features of the Z-closure member being depicted.
FIG. 4 is a schematic opposing right end elevational view of the Z-closure member shown in FIG. 3 without the representative filter.
Figure 5:
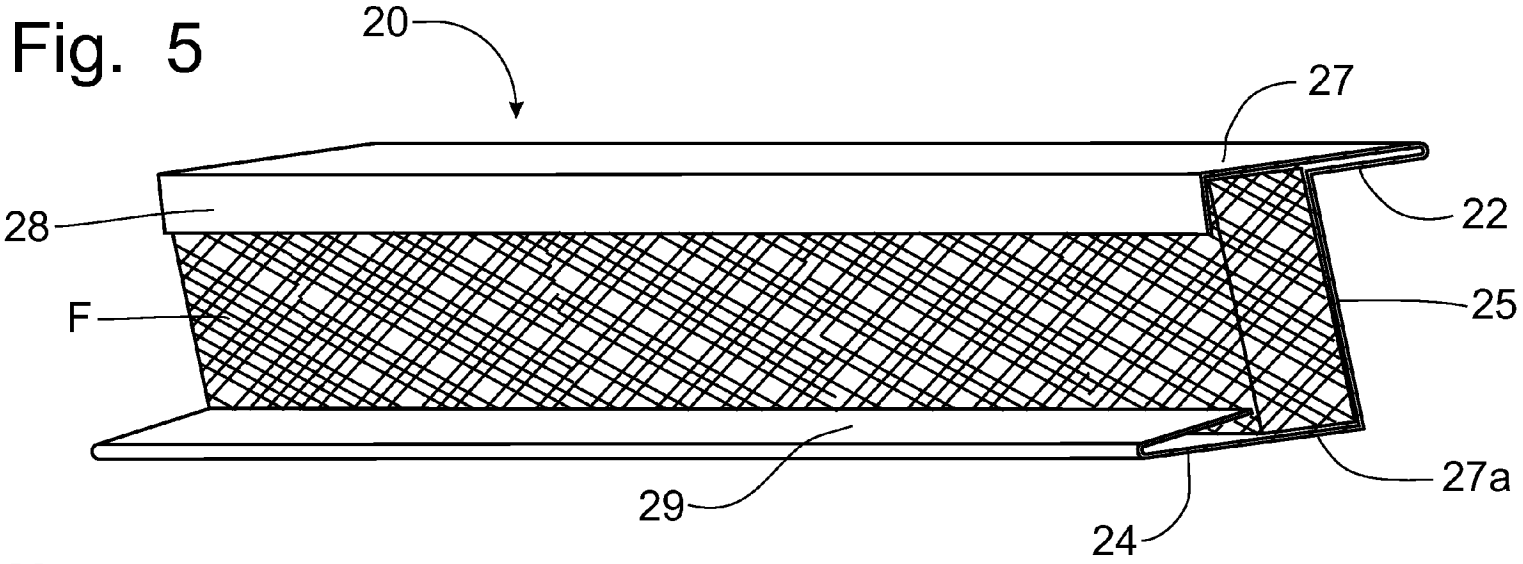
FIG. 5 is a schematic rear perspective view of the Z-closure member shown in FIG. 3 with a representative filter being depicted.
Figure 6:
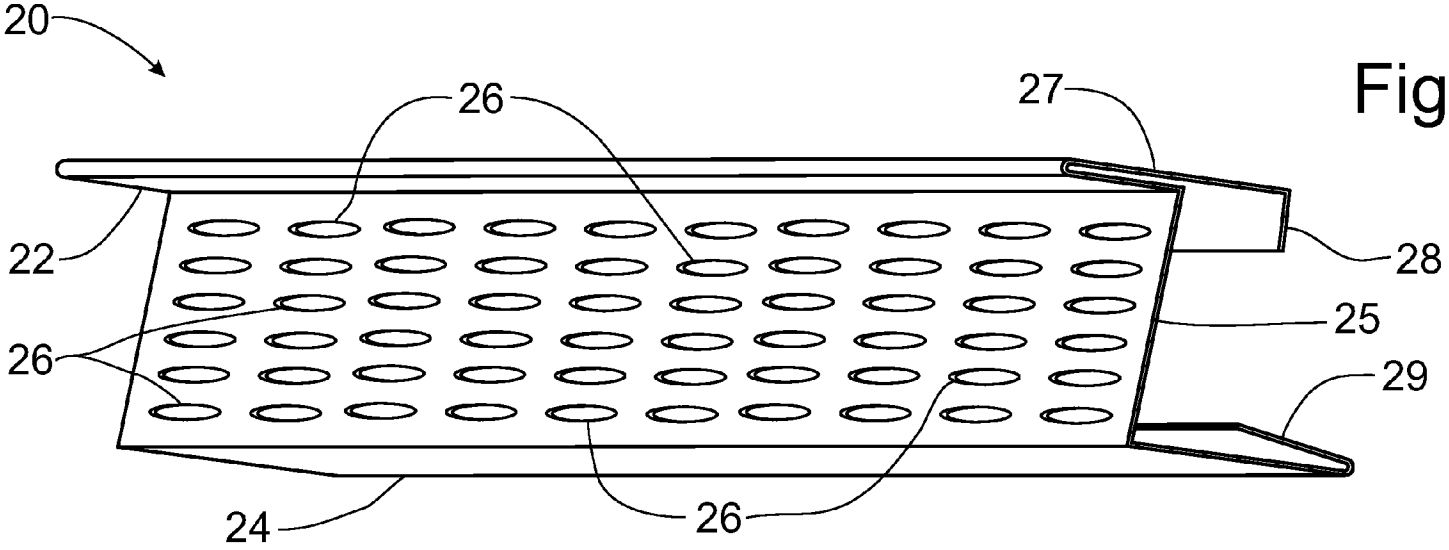
FIG. 6 is a schematic front perspective view of the Z-closure member shown in FIG. 3 without a representative filter.
Figure 7:
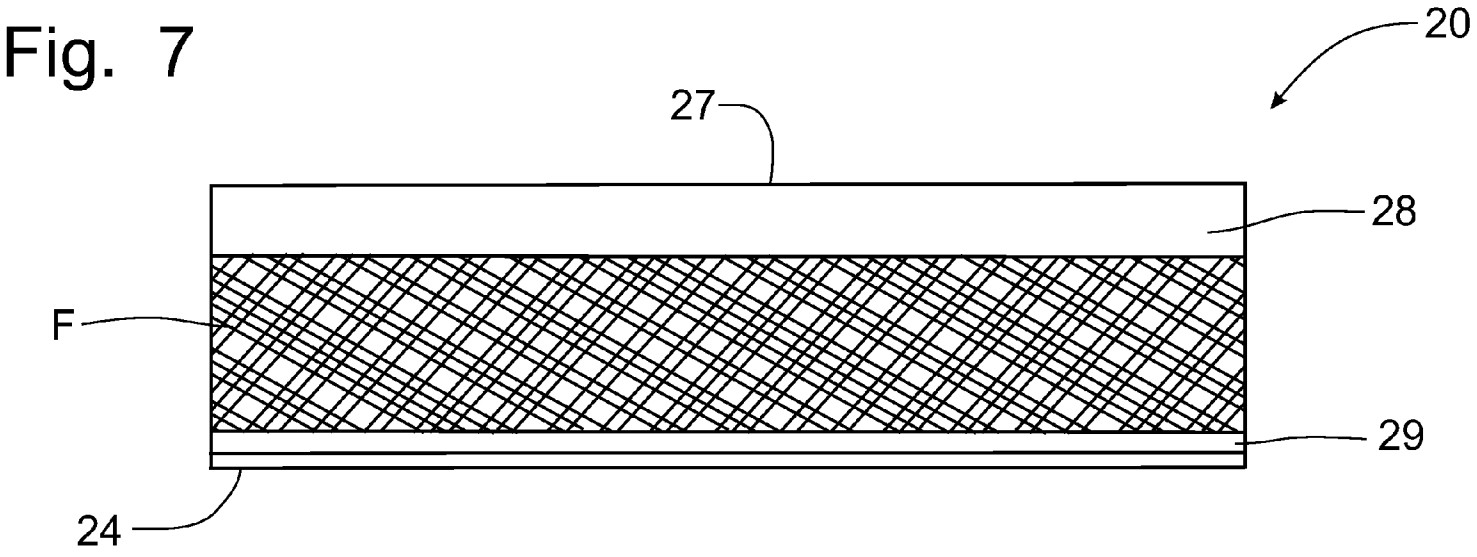
FIG. 7 is a schematic rear elevational view of the Z-closure member shown in FIG. 3 including a representative filter secured by the retention features of the Z-closure member.
Figure 8:
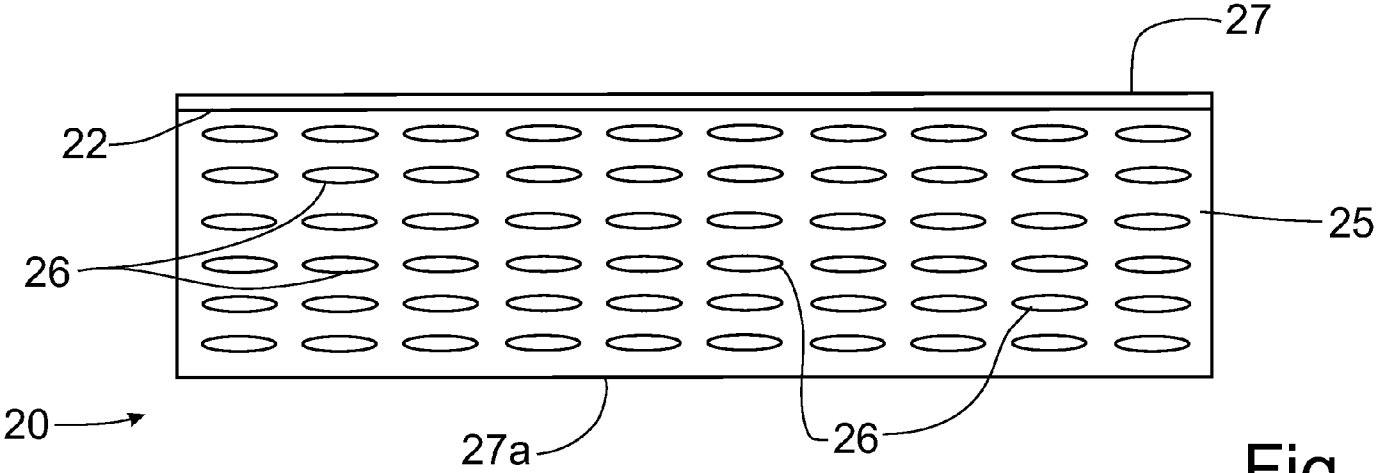
FIG. 8 is a schematic front elevational view of the Z-closure member shown in FIG. 3.
Figure 9:
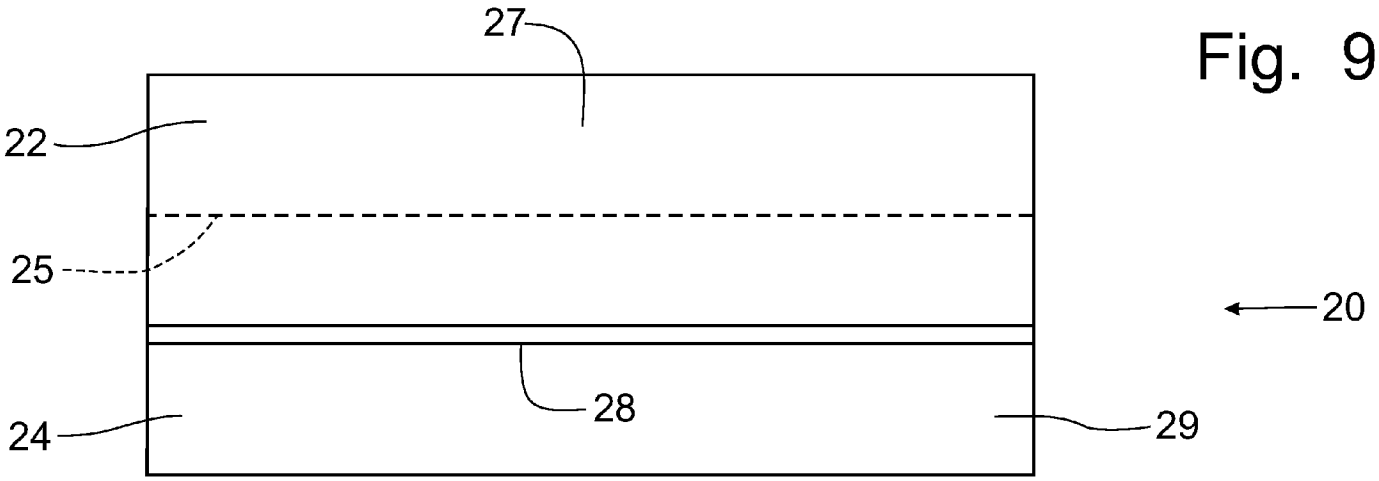
FIG. 9 is a schematic top plan view of the Z-closure member shown in FIG. 3.
Figure 10:
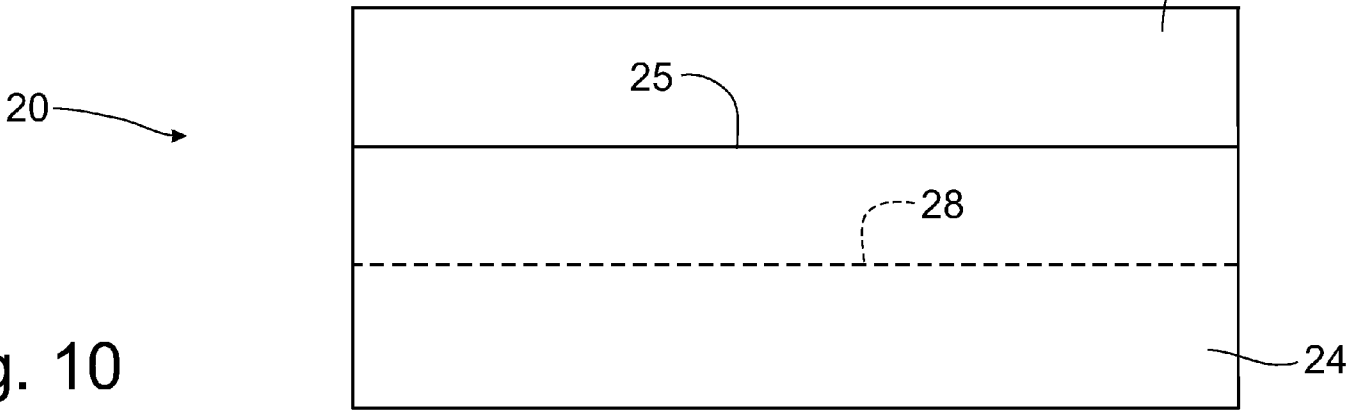
FIG. 10 is a schematic bottom plan view of the Z-closure member shown in FIG. 3.

Referring now to drawings, and particularly to FIGS. 1 and 2, the mounting of a vent cap to a raised seam roof structure utilizing a Z-closure member incorporating the principles of the instant invention can best be seen. References are made to front and rear, top and bottom, and can be determine by standing outside of the vent cap and looking at the front side facing the exterior of the roof structure. Thus, the top surface would be positioned adjacent to the vent cap, the bottom surface would be adjacent to the roof panels, and the rear surface would be facing the interior of the vent cap. References herein to horizontal and vertical are made with the Z-closure member being supported on a horizontal plane, although the typical placement of the Z-closure member to mount a vent cap to a raised seam roof orients the Z-closure member at an angle to a horizontal plane.

The Z-closure member 20 is best seen in FIGS. 3-10 and is formed by bending a single sheet of metal into the configuration shown, which includes retention features that secure a filter F to prevent insects and debris from passing through the Z-closure member 20. The Z-closure member 20 is formed to include an upper horizontal flange 22, a lower horizontal flange 24 and a central vertical member 25 interconnecting the upper and lower flanges 22, 24. The central vertical member 25 is preferably formed with a plurality of ventilation openings 26 to permit the passage of air through the Z-closure member 20. The specific shape of the ventilation openings 26 are shown to be an oval configuration; however, one of ordinary skill in the art will recognize that many other shapes for the ventilation openings 26 can be utilized, including round or other geometric shapes.

The Z-closure member is uniquely formed through sheet metal bending techniques to have an upper tab member 28 extending from the upper horizontal flange 22 that secures an upper portion of the filter F, and a lower flexible locking tab 29 extending from the lower horizontal flange to secure a lower portion of the filter F, as will be described in greater detail below, such that the filter F is secured in position adjacent the rear face of the central vertical member 25 to filter the air passing through the ventilation openings 26.

Beginning at the uppermost edge of the central member 25, the upper flange 22 is bent at approximately a 90 degree angle to extend forwardly from the front face of the central member 25 to the terminus of the upper flange 22. The Z-closure member 20 then bends through approximately 180 degrees to create an upper retainer member 27 that doubles back over the upper flange 22 and passes rearwardly of the central member 25 to overlie the filter F. The upper tab member 28 is then formed by a downward bend through an angle slightly less than 90 degrees so that the upper tab member 28 will trap the upper portion of the filter F at the bend for the upper tab member 28, but the upper tab member 28 flares rearwardly to facilitate the insertion of the filter F, as will be descried in greater detail below.

Beginning then at the lowermost edge of the central member 25, the lower flange 24 is formed through a rearward bend of approximately 90 degrees so that the Z-closure member 20 extends rearwardly of the central member 25 underneath the filter F to form a lower retainer member 27*a* and the lower flange 24 extending rearwardly of the central member 25 and the filter F. The Z-closure member 20 then does a reverse bend of slightly less than 180 degrees to extend forwardly to form the lower flexible locking tab 29 in a manner that projects upwardly so that the forward terminus of the lower flexible locking tab 29 will engage a lower portion of the filter F, once inserted. The flexible lower locking tab 29 has a slight range of vertical movement that allows the insertion of the filter F into position against the rearward face of the vertical member 25.

The insertion of the filter F can be easily accomplished by first positioning the upper portion of the filter F against the upper retainer member 27, slipping in front of the upper tab member 28. The rearward inclination of the upper tab member 28 allows the filter F to be angled into position against the upper retainer member 27. Once oriented into the upper portion of the Z-closure member 20 against the upper retainer member 27, the lower portion of the filter F can be pressed toward the vertical member 25 by deflecting the lower locking tab 29 downwardly to permit the filter F to pass into position against the lower retainer member 27*a*. Once the filter F is located past the flexible lower locking tab 29, the lower locking tab 29 will deflect upwardly to engage the lower portion of the filter F. Thus, the filter F is secured into position against the rear face of the vertical member 25 by the upper tab member 28 and the lower locking tab 29 without requiring the use of special fasteners or special formed retainer members such as disclosed in U.S. Pat. No. 5,605,022.

The Z-closure member 20 is utilized to secure a vent cap 15 to the roof panels 12 of a raised seam roof system 10. With reference to FIGS. 1 and 2, one skilled in the art will recognize that the Z-closure member 20, as described above, can be secured to the central planar portion of a roof panel 12 between the upright legs 13 thereof by fasteners 14 passing through the lower locking tab 29 and the lower horizontal flange 24. Typically, the Z-closure member 20 is first secured to the roof panels 12 before the vent cap 15 is installed. By connecting the Z-closure members 20 at the same location along the respective roof panels 12, the upper flanges 22 of the respective Z-closure members 20 will be aligned on opposing sides of the peak of the roof 10. As best seen in FIG. 1, the Z-closure member 20 is oriented with the front face of the vertical member 25 facing downwardly toward the exterior of the roof system 10 with the lower flange being directed toward the peak of the roof system 10 and the upper flange being oriented away from the roof peak.

Once the roof panels 12 have been installed with the Z-closure members 20 attached as described above, the vent cap 15 can be installed. The vent cap 15 is formed with a return lip 16 on both opposing sides thereof to define a receiving slot 17. The vent cap 15 can then be installed by sliding the vent cap 15 onto the upper flange 22, positioned within the receiving slot 17. Once mounted onto the upper flanges 22, the vent cap can be fixed into position be inserting a fastener 18, such as a rivet, through the vent cap 15 into engagement with the upper flange 22. Because of the engagement of the vent cap 15 onto the upper flanges 22 of the Z-closure members 20, the vent cap 15 does not require many fasteners 18 to fix the vent cap 15 on the roof system 10. In fact, two fasteners 18 per roof panel 12 have been found to be sufficient to retain the position of the vent cap on the Z-closure members 20.

The Z-closure members 20 are configured to engage with raised seam roof panels 12 and to present an upper flange 22 above the seam of co-joined panels 12 that permits the mounting of a simple vent cap 15 onto the upper flanges 22 of the respective Z-closure members 20 along the line of the roof peak. The simple vent cap 15 can be formed by a single bend at the center of the vent cap 15, along with the opposing bends to form the return lip 16 and the receiving slot 17, as opposed to a more complex vent cap, such as shown in U.S. Pat. Nos. 5,427,571 and 5,605,022, that creates a raised vent cap body to permit the flow of air through the corresponding closure member and into the vent cap. The Z-closure member 20 according to the instant invention allows a flow of air through the central member 25 in flow communication with the vent cap 15 without requiring a raised portion to be formed in the vent cap 15. Thus, the use of the Z-closure 20 with the simple vent cap 15 reduces the costs of installing a raised seam roof system 10.

Figure 17:
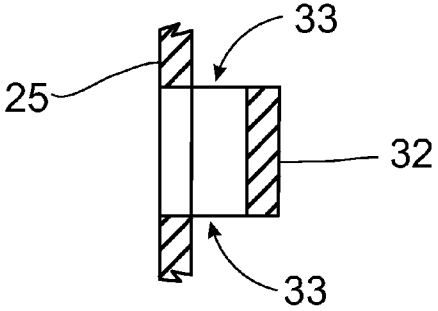
FIG. 17 is an enlarged cross-sectional view of one of the ventilation openings corresponding to lines A-A of FIG. 16.
Figure 11:
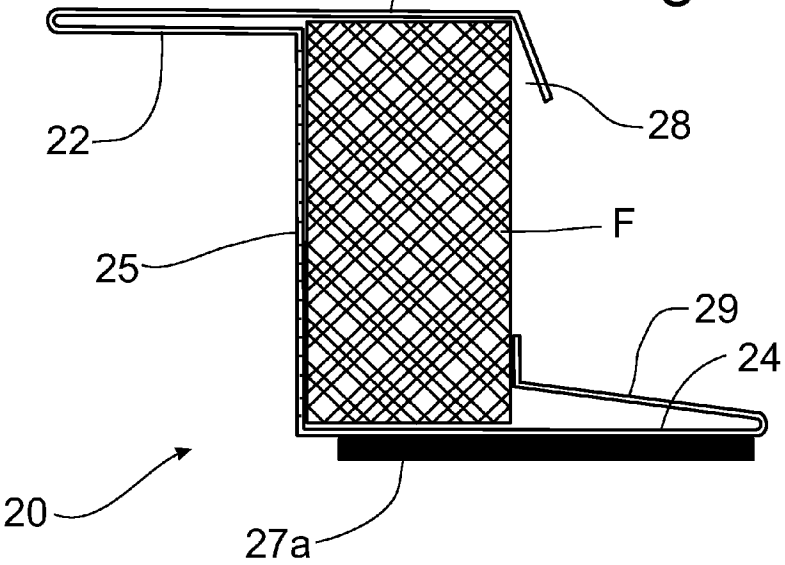
FIG. 11 is a schematic left elevational view of a second embodiment of the Z-closure member incorporating the principles of the instant invention, a representative filter secured by the retention features of the Z-closure member being depicted.
Figure 12:
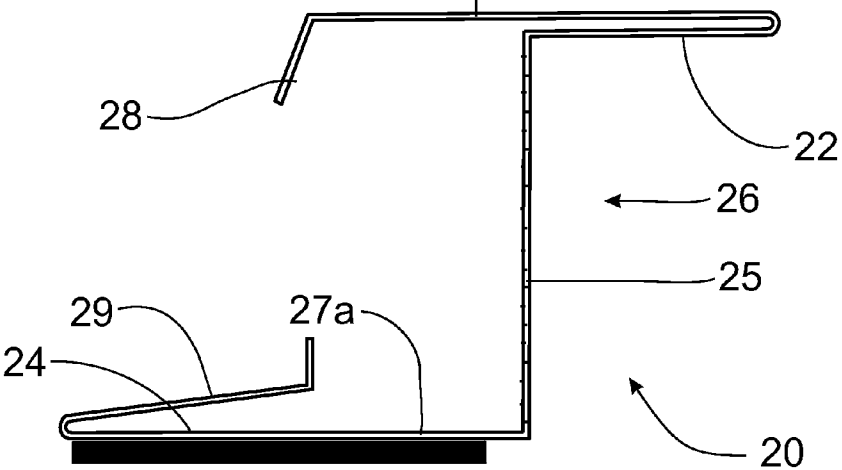
FIG. 12 is a schematic opposing right end elevational view of the second embodiment of the Z-closure member shown in FIG. 11 without the representative filter.
Figure 13:
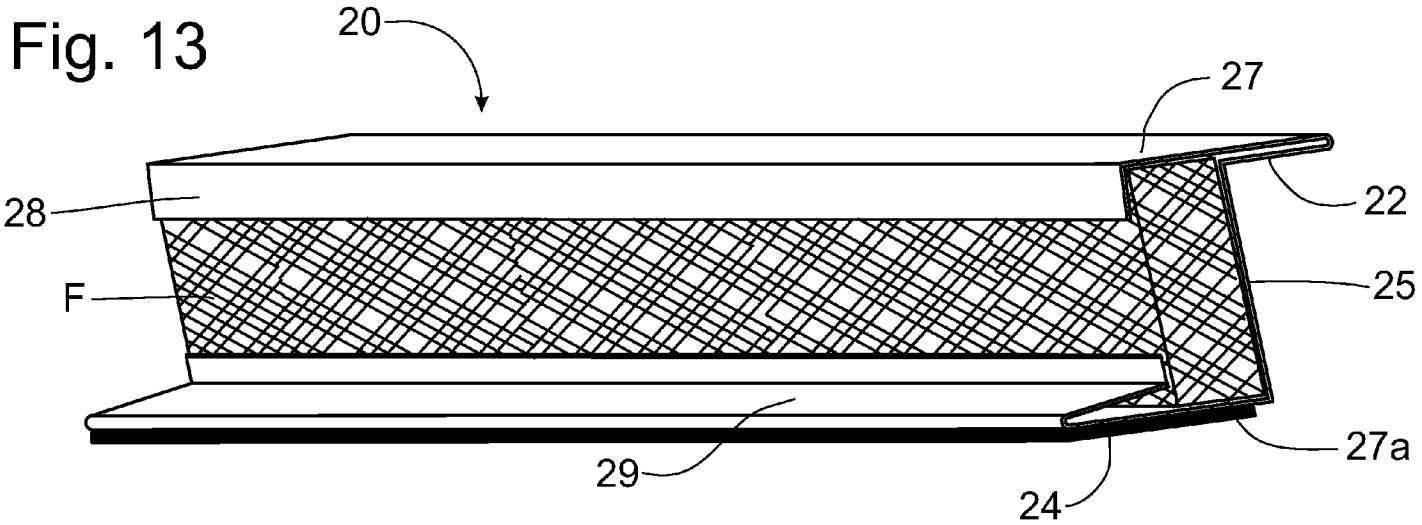
FIG. 13 is a schematic rear perspective view of the second embodiment of the Z-closure member shown in FIG. 11 with a representative filter being depicted.
Figure 14:
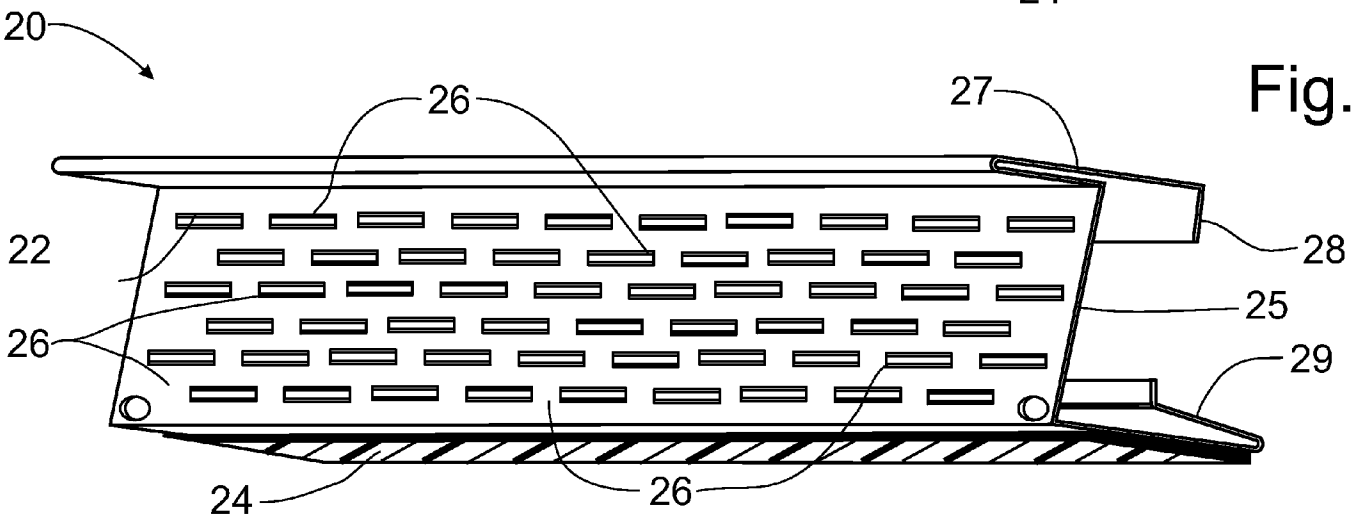
FIG. 14 is a schematic front perspective view of the second embodiment of the Z-closure member shown in FIG. 11 without a representative filter.
Figure 15:
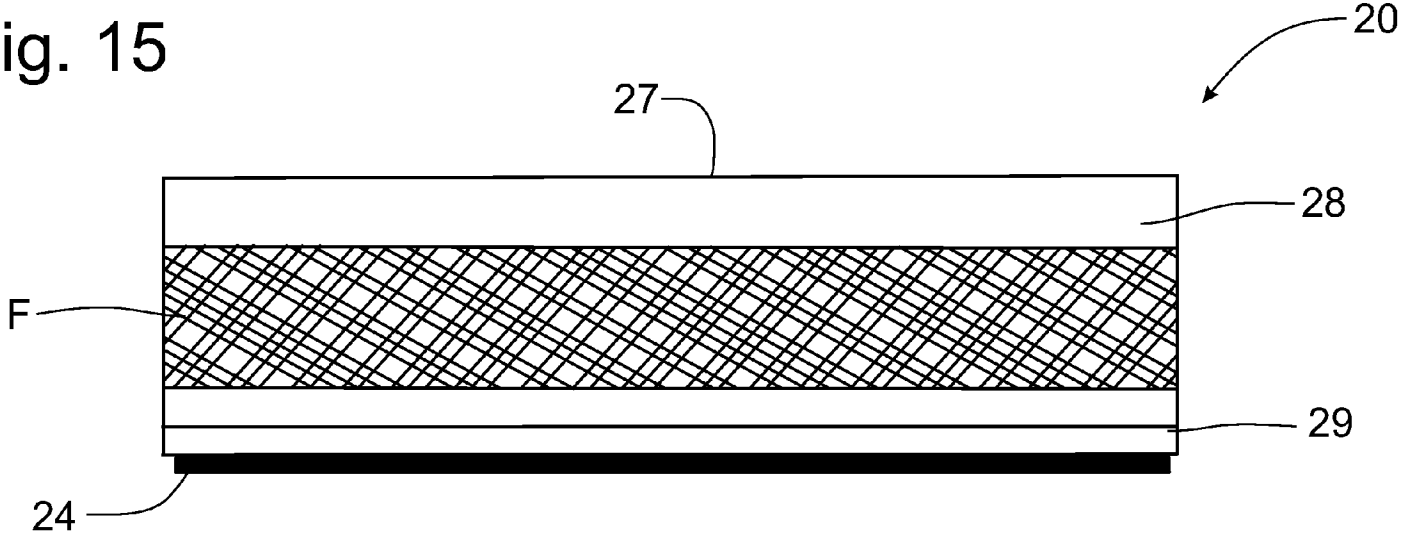
FIG. 15 is a schematic rear elevational view of the second embodiment of the Z-closure member shown in FIG. 11 including a representative filter secured by the retention features of the Z-closure member.
Figure 16:
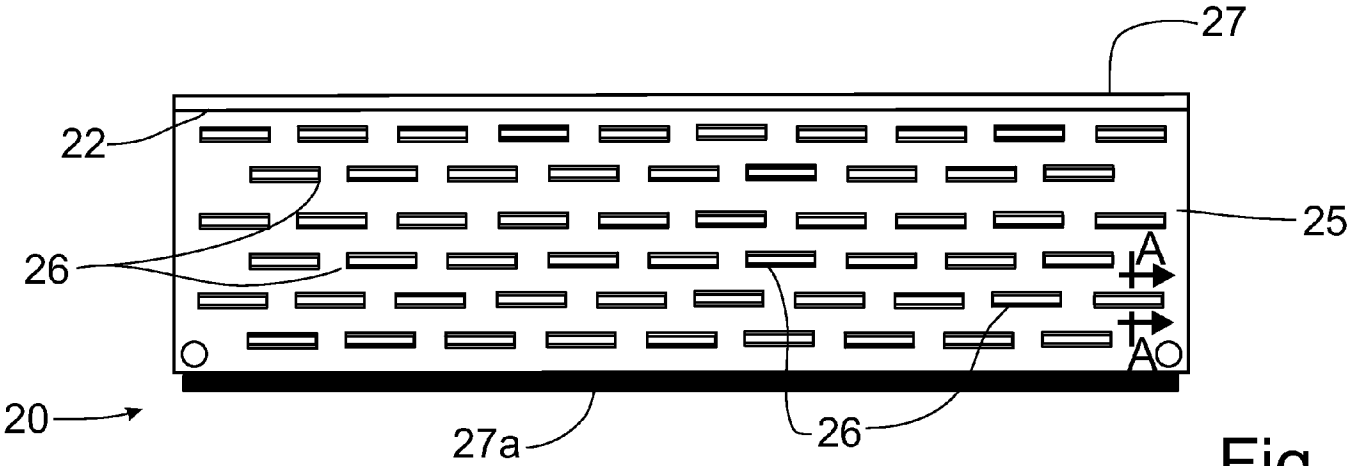
FIG. 16 is a schematic front elevational view of the second embodiment of the Z-closure member shown in FIG. 11.

A second embodiment of the Z-closure member 20 according to the principles of the instant invention is depicted in FIGS. 11-17. The overall configuration is substantially identical to the first embodiment of the Z-closure member 20 depicted in FIGS. 3-10, except for a few additional features added. An optional lower tab member 28*a* is added to the lower flexible locking tab 29 to provide additional engagement with the filter F to assist in retaining the filter F in place against the central vertical member 25. An alternative configuration for the ventilation openings 26 is also shown. This particular configuration shown in FIGS. 14, 16 and 17 is commonly referred to as a "basket weave" opening and is formed by piercing along the top and/or bottom edges of the opening 26 to retain the strip 32 of metal in the center of the opening 26 which is bent inwardly to provide small ventilation openings 33 along the center strip of metal vertically above and below the center strip 32. This center strip 32 of metal allows the opening 26 to be more resistant to the entry of rain water than the punched holes 26. Yet another configuration of the ventilation openings 26 is a louvered opening (not shown) in which metal is pierced along one horizontal top or bottom side and the central portion is bent accordingly to open the pierced side into an opening. The bent portion can be bent inwardly or outwardly as desired to provide air ventilation through the central member 25 while restricting entry of rain water.

This second embodiment of the Z-closure member 20 shown in FIGS. 11-16 also includes an optional elastomeric strip 30 to seal the lower flange 24 against the roof panel 12, particularly the screws 14 that connect the Z-closure member 20 to the roof panel 12. Preferably, the elastomeric strip 30 is positioned only along the bottom portion of the lower flange 24 corresponding to the flexible locking tab 29 so that the elastomeric strip 30 will not be readily seen once the Z-closure member 20 is installed on a roofing panel 12. The elastomeric strip 30 will extend along the entire length of the lower flange 24 so as to extend from one upright leg 13 to the other upright leg 13 on the raised seam roofing panel 12. With the fasteners 14 passing through the flexible locking tab 29 and the upper flange 24 through the elastomeric strip 30 and into the body portion of the roofing panel 12, the elastomeric strip will seal the holes through the Z-closure member 20 and the roofing panel 12 and prevent the passage of rain water through the screw holes into the structure covered by the roofing panels 12.

Under certain wind and rain conditions, such as extremely high winds and rain carried thereby into the ventilated face of the central vertical member 25, slight amounts of rain water can pass through the ventilation openings 26, irrespective of the shape of configuration of the openings 26. Such rain infiltration will be halted by the mesh filter F and settle to the bottom of the filter F against the bottom of the Z-closure member 20. The placement of weep holes **26*a* along the bottom of the central vertical member 25 will enable the collected infiltration of rainwater to drain from the Z-closure member once the rainfall has ceased. Weep holes 26*a* are shown at the opposing edges of the Z-closure member 20, but additional weep holes 26*a* can be added, if necessary, particularly at the center of the bottom of the central vertical member 25**.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A Z-shaped closure member for mounting a vent cap on a raised seam roof structure, comprising:

a central member having a front face and a rear face and being formed with ventilation openings;

an upper flange extending forwardly from an upper end of said front face approximately orthogonally thereto;

an upper retainer member extending from a front terminus of said upper flange in an overlying manner relative thereto to a position spaced a predetermined distance rearwardly of the rear face of said central member;

an upper tab member extending downwardly therefrom and terminating below said upper retainer member and rearwardly of the rear face of said central member;

a lower flange extending rearwardly from a lower end of said front face approximately orthogonally thereto;

a flexible locking tab extending forwardly from a rear terminus of said lower flange and terminating rearwardly of the rear face of said central member and above said lower flange; and wherein the Z-shaped closure member is a continuous unitary structure of one-piece construction.

2. The Z-shaped closure member of claim 1 further comprising a filter positioned adjacent the rear face of said central member, said filter being retained in position against said rear face by said upper tab member and said locking tab.

3. The Z-shaped closure member of claim 1 wherein said locking tab includes a lower tab member extending upwardly from said flexible locking tab.

4. The Z-shaped closure member of claim 1 wherein said central member is formed with weep holes adjacent said lower flange.

5. The Z-shaped closure member of claim 1 wherein said ventilation openings are formed with vertically oriented slots and a central strip bent from said central member.

6. The Z-shaped closure member of claim 1 wherein said lower flange includes a seal member mounted thereon and being positioned on a lower side of said lower flange opposite from said flexible locking tab.

7. The Z-shaped closure member of claim 6 wherein said seal member is formed of elastomeric material and extends along the lower side of said lower flange for a distance substantially equal to a length dimension of said locking tab.

8. A Z-shaped closure member for mounting a vent cap on a raised seam roof structure, comprising:

a central member having a front face and a rear face and being formed with ventilation openings;

an upper flange integral with said central member and extending forwardly from an upper end of said front face approximately orthogonally thereto;

an upper retainer member integrally formed with said upper flange and extending from a front terminus of said upper flange in an overlying manner relative thereto to a position spaced a predetermined distance rearwardly of the rear face of said central member;

an upper tab member integral with said upper retainer member and extending downwardly therefrom and terminating below said upper retainer member and rearwardly of the rear face of said central member;

a lower flange integral with said central member and extending rearwardly from a lower end of said front face approximately orthogonally thereto;

a flexible locking tab integrally formed with said lower flange and extending forwardly from a rear terminus of said lower flange and terminating rearwardly of the rear face of said central member and above said lower flange; and a filter positioned adjacent the rear face of said central member, said filter being retained in position against said rear face by said upper tab member and said locking tab.

9. The Z-shaped closure member of claim 8 wherein said lower flange includes an elastomeric seal member mounted thereon and being positioned on a lower side of said lower flange opposite from said flexible locking tab, said seal member extending along the lower side of said lower flange for a distance substantially equal to and corresponding to a length dimension of said locking tab.

10. The Z-shaped closure member of claim 9 wherein said locking tab includes a lower tab member extending upwardly from said flexible locking tab.

11. The Z-shaped closure member of claim 9 wherein said central member is formed with weep holes adjacent said lower flange, said ventilation openings being formed with vertically oriented slots and a central strip bent from said central member.

12. A raised seam roof structure comprising:

a plurality of roof panels having a central planar portion and a pair of upright legs, said roof panels being arranged in opposing downwardly sloping orientations meeting proximate to a roof peak;

a plurality of Z-shaped closure members having integral upper and lower flanges and a central member interconnecting said upper and lower flanges, said Z-shaped closure members being mounted on at least a portion of said roof panels in an opposing configuration by connecting each respective said lower flange to a corresponding central planar portion of a corresponding said roof panel, the central portion of at least a portion of said Z-shaped closure members being formed with ventilation openings and having a filter positioned adjacent a rear face of said central member, each Z-shaped closure member including formed retention members engaging said filter to retain said filter against said rear face, said retention members being integral with said upper and lower flanges;

said central member having a front face and said rear face;

said upper flange being integral with said central member and extending forwardly from an upper end of said front face approximately orthogonally thereto;

an upper retainer member integrally formed with said upper flange and extending from a front terminus of said upper flange in an overlying manner relative thereto to a position spaced a predetermined distance rearwardly of the rear face of said central member;

one of said retention members being an upper tab member integral with said upper retainer member and extending downwardly therefrom and terminating below said upper flange and rearwardly of the rear face of said central member;

said lower flange being integral with said central member and extending rearwardly from a lower end of said front face approximately orthogonally thereto;

a second of said retention members being a flexible locking tab integrally formed with said lower flange and extending forwardly from a rear terminus of said lower flange and terminating rearwardly of the rear face of said central member and above said lower flange; and a vent cap secured to said upper flanges of said Z-shaped closure members to cover said roof peak.

13. The raised seam roof structure of claim 12 wherein said flexible locking tab is also formed with an upright lower tab member engagable with said filter.

14. The raised seam roof structure of claim 12 wherein said lower flange includes a seal member mounted thereon and being positioned on a lower side of said lower flange opposite from said flexible locking tab.

15. The raised seam roof structure of claim 14 wherein said seal member is formed of elastomeric material and extends along the lower side of said lower flange for a distance substantially equal to a length dimension of said locking tab.

16. The raised seam roof structure of claim 12 wherein said central member is formed with ventilation openings.

17. The raised seam roof structure of claim 16 wherein said central member is formed with weep holes adjacent said lower flange.

18. The raised seam roof structure of claim 16 wherein said ventilation openings are formed with vertically oriented slots and a central strip bent from said central member.

* * * * *